US005926973A

United States Patent [19]

Marschke

[11] Patent Number: 5,926,973

[45] Date of Patent: Jul. 27, 1999

[54] VACUUM ASSISTED BELTLESS HOLDDOWN FOR DOUBLE BACKER

[75] Inventor: Carl R. Marschke, Phillips, Wis.

[73] Assignee: Marquip, Inc, Phillips, Wis.

[21] Appl. No.: 09/035,309

[22] Filed: Mar. 5, 1998

[51] Int. Cl.[6] ..... F26B 9/00

[52] U.S. Cl. ..... 34/634; 34/635; 34/646

[58] Field of Search ..... 34/624, 629, 634, 34/635, 646, 662, 443, 452, 453; 156/470, 497, 580, 583.3; 226/95, 170

[56] References Cited

U.S. PATENT DOCUMENTS

| | | | |
|---|---|---|---|
| 3,319,353 | 5/1967 | Matsunami et al. . | |
| 3,340,125 | 9/1967 | Drenning et al. . | |
| 4,889,580 | 12/1989 | Seki et al. . | |
| 4,905,381 | 3/1990 | Poterala | 34/634 |
| 4,947,559 | 8/1990 | Basler et al. . | |
| 5,471,765 | 12/1995 | Rautakorpi et al. | 34/634 X |
| 5,566,472 | 10/1996 | Lehtinen et al. | 34/634 X |
| 5,600,900 | 2/1997 | Marschke | 34/92 X |
| 5,857,605 | 1/1999 | Welch et al. | 226/95 |

FOREIGN PATENT DOCUMENTS

| | | |
|---|---|---|
| 1046813 | 4/1964 | United Kingdom . |

*Primary Examiner*—Henry Bennett
*Assistant Examiner*—Steve Gravini
*Attorney, Agent, or Firm*—Andrus, Sceales, Starke & Sawall

[57] ABSTRACT

An essentially non-contact holddown system for a corrugator double backer utilizes vacuum pressure through the lower heating section which supports the double face corrugated web. Continuous edge sealing membranes overlie the edges of the web and form, with the web edge and the surface of the heating section, vacuum chambers into which air is drawn from the flute spaces in the double face web.

11 Claims, 1 Drawing Sheet

VACUUM ASSISTED BELTLESS HOLDDOWN FOR DOUBLE BACKER

BACKGROUND OF THE INVENTION

The present invention relates to a double backer for the formation of a double face corrugated web and, more particularly, to an improved system for providing a vacuum holddown force to the web moving through a double backer heating section while minimizing the vertical load.

In a conventional double backer, a liner web is brought into contact with the glued flute tips of a single face corrugated web, and the freshly glued double face web is then passed over the coplanar surfaces of a number of serially arranged heating units, usually steam heated, to cause the starch-based glue to cure and to drive moisture from the web. For many years, double face web travel over the flat heated surfaces of the heating units was typically provided by a wide driven holddown belt in direct contact with the upper face of the corrugated web. The top face of the holddown belt, in turn, is held in contact with the moving web by any of several types of load or force applying devices. For example, the holddown belt may be engaged by a series of weighted ballast rollers, or it may be forced into contact with the web by air pressure from a system of nozzles positioned over the belt, or an arrangement of inflatable air bladders may be used to press the moving holddown belt into contact with the web.

The use of a driven holddown belt has always been encumbered with a number of disadvantages. The belt must be mounted for continuous travel in the manner of a conventional conveyor belt system and, therefore, must also include a separate belt drive. The holddown belt also must necessarily overlie the entire surface of the double face web through the heating section and, as a result, may actually inhibit the escape of moisture from the web as it dries. Also, the edges of the belt which overhang the edges of the corrugated web tend to crush the edges and also undesirably run in contact with the heating surfaces laterally beyond the moving web.

More recently, a double backer has been developed in which the driven holddown belt has been eliminated. A stationary holddown mat is supported by its upstream and downstream ends which are vertically adjustable to allow a selected portion of the mat to hang in catenary fashion on the upper surface of the corrugated double face web traveling through the heating section. The web is typically pulled through the heating section by a downstream vacuum conveyor.

Systems utilizing moving holddown belts are both cumbersome and costly. The improved stationary direct contact holddown systems, though providing significant improvements over holddown belt systems, require a web drive system with fairly high operating power requirements.

SUMMARY OF THE INVENTION

In accordance with the present invention, a double backer operates without a holddown belt and the holddown force is provided with negative air or vacuum pressure applied to the web through the web supporting surface of the heating section. The apparatus of the present invention comprises a pair of flexible edge sealing membranes, each of which is positioned to extend along and to overlie a lateral edge of the web in the heating section and rest upon a portion of the upper liner web and an adjacent portion of the heating surface. The membrane, the heating surface and the vertical face of the lateral edge of the web form a small vacuum chamber along the edge. A source of negative pressure is connected to communicate with the vacuum chambers through the heating surface to draw air from the flute spaces in the double face web and to draw the liner webs into intimate contact with the corrugated medium web. The apparatus is adaptable for use with a conventional double backer in which the heating surface comprises a series of heating units having coplanar surfaces aligned in the direction of web movement, so that the communication between the negative pressure source and the vacuum chambers may comprise vacuum passages between adjacent heating units. Specifically, the vacuum passages comprise slots, each having an effective length in a direction laterally across the heating surface greater than the width of the web. Preferably, the vacuum passages further provide communication with a portion of the membrane resting on the heating surface to draw the membrane portion into sealing contact with the heating surface. Alternately, a portion of the membrane which rests on the heating surface may be sealingly attached thereto.

The apparatus also includes upstream and downstream membrane supports to which the respective ends of the membranes are attached. Each of the supports includes a lift device operative to move the membranes vertically upwardly and out of contact with the web and the heating surface. The lift devices may also be movable laterally in the cross machine direction to vary the lateral spacing between the sealing membranes.

Supplemental heating may be provided by a radiant heating device supported over the web in the heating section. For example, the heating device may comprise an infrared heater.

In accordance with the method of the present invention, a holddown force is applied to a double face corrugated paperboard web moving over and in contact with the heating surface in the heating section of a double backer through the steps of (1) placing a pair of flexible membranes over the web and the heating surface and positioning each membrane to extend along one lateral edge of the web, (2) resting each of the membranes on an edge portion of the upper liner web and the heating surface adjacent the web edge to form a vacuum chamber which is defined by the membrane, the heating surface and the vertical face of the edge of the web, and (3) evacuating the vacuum chambers through the heating surface to draw air from the flute spaces in the web and to draw the component medium and liner webs together. The evacuating step preferably comprises providing the heating surface with vacuum passages in communication with the vacuum chambers, and including the step of applying a vacuum to the passages from a vacuum source. The preferred method also includes the step of moving the membranes laterally in the cross machine direction to vary the lateral spacing therebetween. The method may also include the step of placing a heating device over the web in the heating section.

DETAILED DESCRIPTION OF THE PREFERRED EMBODIMENT

Figure 3:
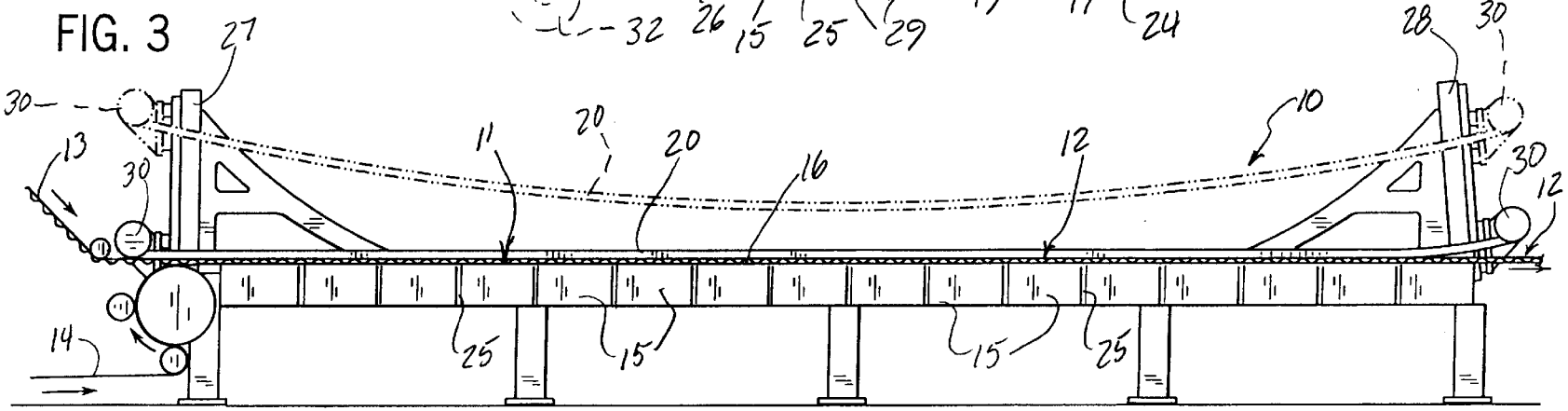
FIG. 3 is a generally schematic side elevation view of the double backer incorporating the holddown apparatus of the present invention.

In the generally schematic representation in FIG. 3, there is shown a double backer 10 having a lower heating section 11 of generally conventional construction. A double face corrugated web 12 is formed by joining a single face corrugated web 13 and a liner web 14. The flute tips of the corrugated medium of the single face web 13 are covered with a starch-based adhesive in an upstream glue machine (not shown) and the adhesive bonds between the glued flute tips and the liner web 14 are cured by the application of heat and pressure in the double backer 10. Heat is supplied from below by a series of heating units 15 having flat, coplanar heating surfaces 16 over which the joined double face web 12 travels through the double backer. The heating units typically comprise individual steam chests which are fabricated of a heavy-walled cast iron or steel construction, but may also comprise any suitable flat heated surface. Each steam chest has an open interior to which high pressure steam is supplied in a known manner and utilizing a steam supply system which is not shown. Each heating unit 15 may be 18–24" (about 406–610 mm) in length (in the direction of web movement) and have a width in the cross machine direction sufficient to fully support the maximum width of corrugated web to be processed (e.g. 96" or about 2500 cm). The total length of the heating section 11 may be about 40 feet (about 12 m).

Figure 1:
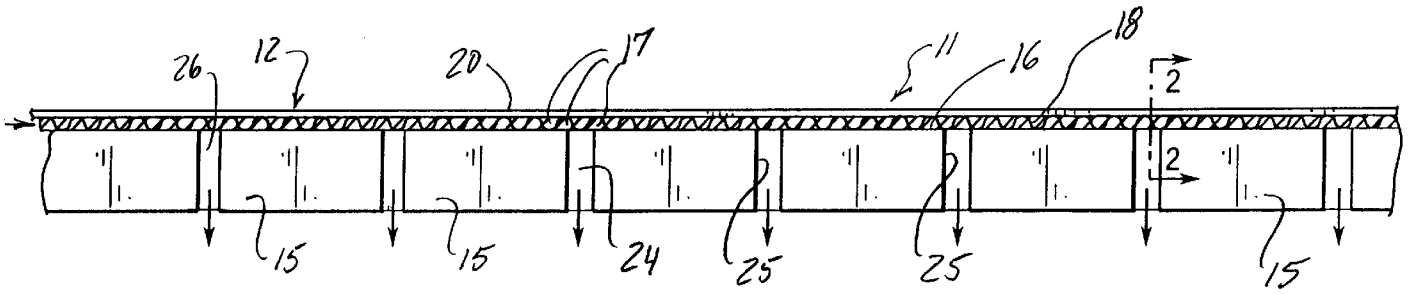
FIG. 1 is an enlarged side elevation detail of a portion of the double backer shown in FIG. 3.
Figure 2:
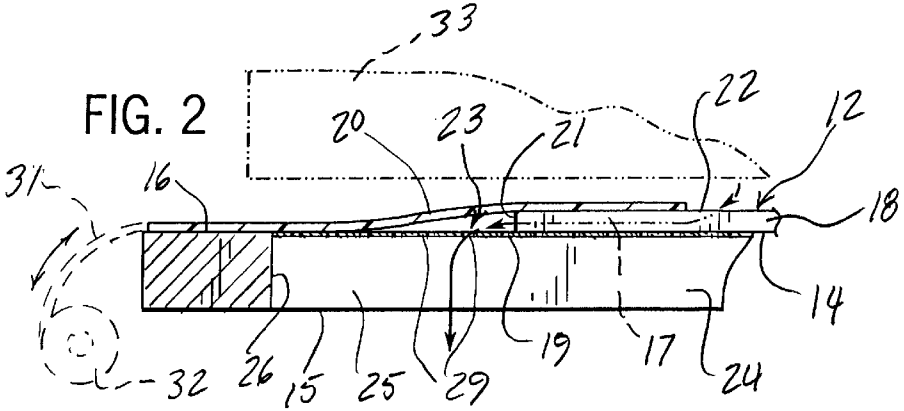
FIG. 2 is a vertical sectional detail taken on line 2—2 of FIG. 1.

In accordance with the present invention and referring also to FIGS. 1 and 2, a vacuum holddown force is applied to the double face corrugated web 12 by drawing air out of the flute spaces 17 defined by the enclosed corrugated medium web 18. To enable the vacuum to be drawn on the interior of the corrugated web 12, a pair of flexible edge sealing membranes 20 are utilized to provide a part of an enclosed vacuum system. Each of the membranes is positioned to extend along the heating section 11 to overlie one lateral edge 21 of the web 12. Each membrane extends in both lateral directions from the edge of the web such that it rests upon an edge portion of the upper liner web 22 and an adjacent portion of the heating surface 16. The flexible membrane 20 is relatively stiff and the portion which bridges the edge 21 of the web forms with the web and the heating surface a continuous vacuum chamber 23. Vacuum is applied to the vacuum chambers 23 by a conventional source of negative pressure, such as a vacuum blower, via vacuum passages 24 between the heating units 15. Preferably, the vacuum passages 24 comprise narrow rectangular slots 25 which have effective lengths in the cross machine direction at the heating surfaces 16 to extend laterally beyond the edges 21 of the web. The slots 25 are preferably closed by lateral end walls 26 to minimize vacuum loss. Preferably, the upper ends of the slots 25 at the level of the heating surfaces 16 are covered with an open grid work or a foraminous plate 19. The plate 19 is provided with a pattern of vacuum distribution holes 29, such that the lower liner web 14 of the corrugated web is supported as it passes over the slots, but vacuum flow through the plate is not significantly restricted.

The negative pressure applied to the vacuum slots 25 also serves to pull the membrane edges into sealing contact with the heating surfaces 16 of the heating units. The portion of the membrane 20 resting on the upper liner web 22 of the corrugated double face web should extend far enough thereover to preclude air leakage between the underside of the membrane and the top of the upper liner 22. In this manner, the vacuum pressure will cause air to preferably migrate through the upper liner and into the flute spaces 17. The resultant vacuum force will press the upper liner web 22 and lower liner web 14 against the flutes of the corrugated medium web 18. Simultaneously, the vacuum force also pulls the underside of the lower liner web 14 into intimate contact with the heating surfaces 16 of the heating units.

It is believed that a vacuum sufficient to apply a negative static pressure of about 3" of water (0.75 kPa) is sufficient for most applications. Each of the membranes 20 may have a lateral width of about 24" (610 mm), but the widths as well as the lateral positioning of the web over the lateral edges 21 of the corrugated web may vary to suit operating conditions. Most conveniently, the web 12 is pulled through the double backer 10 by a downstream vacuum conveyor (not shown), the source of vacuum for which may also be used for the holddown system of the present invention.

The membranes 20 are preferably attached by their respective upstream and downstream ends to an upstream support 27 and a downstream support 28. Each of the supports includes a lift device 30 operable to move the membranes vertically upward to lift them off the web and heating surface. Preferably, the lift devices are also movable laterally in the cross machine direction so that the spacing between the membranes 30 may be varied as desired. Lateral variation in the spacing between the membranes maybe utilized to accommodate webs 12 of different widths and also to adjust the amount of the membrane overlying the lateral edge portions of the web.

Referring particularly to FIG. 2, the sealing membrane 20 may also be attached directly to the heating surface 16 along its outermost lateral edge. Alternate means would then have to be provided to lift the free inner edges of the membranes out of the path of an incoming web, as for machine threadup. Alternately, as shown in phantom in FIG. 2, a substantially wider membrane 31 could be wound and unwound from a roll 32 (one on each side of the heating section) to effectively vary the active membrane width and lateral positioning. An optional heating unit 33 may also be suspended over the web in the heating section 11. An infrared heater, for example, would be suitable.

The membranes 20 are preferably made of a tough synthetic material having a low coefficient to thermal expansion, such as KEVLAR. This membrane material may also be combined with a low friction material, such as TEFLON.

As indicated above, a suitable web drive device, such as a vacuum conveyor, is preferably positioned immediately downstream from the downstream end of the heating section 11. Such vacuum conveyors are known in the art. However, the essentially no contact holddown provided by the apparatus of the present invention will reduce considerably the power required to pull the double face web through the system, as compared to stationary holddown systems which lie in direct contact with the web. The actual power required is less than half that required by prior art systems.

I claim:

1. A holddown apparatus for the heating section of a corrugated paperboard double backer of the type having a planar heating surface supporting a moving double face corrugated paperboard web, the double face web including upper and lower liner webs glued to the flute tips of an intermediate corrugated medium web, said apparatus comprising:

a pair of flexible edge sealing membranes, each positioned to extend along and to overlie a lateral edge of the web in the heating section and to rest upon a portion of the upper liner web and the heating surface, such that the membrane, the heating surface and the vertical face of the web lateral edge form a vacuum chamber along said edge; and, a source of negative pressure communicating with the vacuum chambers through the heating surface.

2. The apparatus as set forth in claim 1 wherein the heating surface comprises a series of heating units having coplanar surfaces aligned in the direction of web movement, and further comprising vacuum passages between adjacent heating units providing the communication between the negative pressure source and the vacuum chambers.

3. The apparatus as set forth in claim 2 wherein said vacuum passages comprise slots each having an effective length in a direction laterally across the heating surface greater than the width of the web.

4. The apparatus as set forth in claim 2 including a foraminous support plate enclosing each slot and lying in the plane of said surfaces.

5. The apparatus as set forth in claim 2 wherein said vacuum passages further provide communication with a portion of the membrane resting on the heating surface to draw the membrane portion into sealing contact with the heating surface.

6. The apparatus as set forth in claim 1 wherein a portion of the membrane resting on the heating surface is attached thereto.

7. The apparatus as set forth in claim 1 wherein each of said membranes is movable laterally to selectively vary the width of the membrane portions resting on the web and the heating surface.

8. The apparatus as set forth in claim 1 including upstream and downstream membrane supports to which the respective upstream and downstream ends of the membranes are attached, each of said supports including a lift device operative to move the membranes vertically upwardly and out of contact with the web and heating surface.

9. The apparatus as set forth in claim 8 wherein said lift devices are movable laterally in the cross machine direction to vary the lateral spacing between the sealing membranes.

10. The apparatus as set forth in claim 1 including a radiant heating device supported over the web in the heating section.

11. The apparatus as set forth in claim 10 wherein the heating device comprises an infrared heater.

* * * * *